US007753705B2

(12) United States Patent
Montena

(10) Patent No.: US 7,753,705 B2
(45) Date of Patent: Jul. 13, 2010

(54) FLEXIBLE RF SEAL FOR COAXIAL CABLE CONNECTOR

(75) Inventor: Noah Montena, Syracuse, NY (US)

(73) Assignee: John Mezzalingua Assoc., Inc., E. Syracuse, NY (US)

( * ) Notice: Subject to any disclaimer, the term of this patent is extended or adjusted under 35 U.S.C. 154(b) by 0 days.

(21) Appl. No.: 12/140,573

(22) Filed: Jun. 17, 2008

(65) Prior Publication Data

US 2008/0248689 A1 Oct. 9, 2008

Related U.S. Application Data

(63) Continuation of application No. 11/553,115, filed on Oct. 26, 2006, now abandoned.

(51) Int. Cl.
*H01R 13/52* (2006.01)

(52) U.S. Cl. ..... 439/277

(58) Field of Classification Search ..... 439/277, 439/271, 583, 584, 578, 322
See application file for complete search history.

(56) References Cited

U.S. PATENT DOCUMENTS

| | | | | | |
|---|---|---|---|---|---|
| 3,184,706 | A | * | 5/1965 | Atkins | 439/584 |
| 3,321,732 | A | * | 5/1967 | Forney, Jr. | 439/322 |
| 3,336,563 | A | | 8/1967 | Hyslop | |
| 3,448,430 | A | * | 6/1969 | Kelly | 439/610 |
| 3,537,065 | A | * | 10/1970 | Winston | 439/584 |
| 3,646,502 | A | * | 2/1972 | Hutter et al. | 439/322 |
| 3,706,958 | A | | 12/1972 | Blanchenot | |
| 3,744,011 | A | * | 7/1973 | Blanchenot | 439/584 |
| 3,781,762 | A | * | 12/1973 | Quackenbush | 439/322 |
| 4,173,385 | A | * | 11/1979 | Fenn et al. | 439/277 |
| 4,290,663 | A | * | 9/1981 | Fowler et al. | 439/610 |
| 4,531,805 | A | * | 7/1985 | Werth | 439/607 |
| 4,655,534 | A | * | 4/1987 | Stursa | 439/582 |
| 4,807,891 | A | * | 2/1989 | Neher | 277/392 |
| 5,137,471 | A | | 8/1992 | Verespej et al. | |
| 5,389,005 | A | * | 2/1995 | Kodama | 439/272 |
| 6,331,123 | B1 | | 12/2001 | Rodrigues | |
| 6,406,330 | B2 | * | 6/2002 | Bruce | 439/609 |
| 6,733,336 | B1 | | 5/2004 | Montena et al. | |
| 6,884,113 | B1 | | 4/2005 | Montena | |
| 6,929,508 | B1 | | 8/2005 | Holland | |
| 7,070,447 | B1 | * | 7/2006 | Montena | 439/578 |
| 7,086,897 | B2 | | 8/2006 | Montena | |
| 7,097,499 | B1 | | 8/2006 | Purdy | |
| 7,131,868 | B2 | | 11/2006 | Montena | |
| 7,156,696 | B1 | * | 1/2007 | Montena | 439/584 |
| 2002/0013088 | A1 | | 1/2002 | Rodrigues et al. | |
| 2005/0148236 | A1 | * | 7/2005 | Montena | 439/578 |
| 2006/0110977 | A1 | * | 5/2006 | Matthews | 439/578 |
| 2006/0172571 | A1 | | 8/2006 | Montena | |

* cited by examiner

*Primary Examiner*—Michael C Zarroli
*Assistant Examiner*—Vladimir Imas
(74) *Attorney, Agent, or Firm*—Melissa Bitting

(57) ABSTRACT

The present invention incorporates a flexible seal into a typical coaxial cable connector. The seal comprises a flexible brim, a transition band, and a tubular insert with an insert chamber defined within the seal. In a first embodiment the flexible brim is angled away from the insert chamber, and in a second embodiment the flexible brim is angled inward toward the insert chamber. A flange end of the seal makes a compliant contact between the port and connector faces when the nut of a connector is partially tightened, and becomes sandwiched firmly between the ground surfaces when the nut is properly tightened. The present invention allows the connector to make a uniform RF seal on a port even with a range of tightening torques.

10 Claims, 4 Drawing Sheets

FLEXIBLE RF SEAL FOR COAXIAL CABLE CONNECTOR

CROSS-REFERENCE TO RELATED APPLICATIONS

This application is a continuation of and claims priority from my U.S. application Ser. No. 11/553,115 filed Oct. 26, 2006 now abandoned and entitled FLEXIBLE RF SEAL FOR COAXIAL CABLE CONNECTOR, incorporated herein by reference.

FIELD OF THE INVENTION

The invention relates to connectors for coaxial cables used in CATV applications, and more specifically to the structure for providing solid mechanical and electrical connections between a cable port and connector face.

BACKGROUND OF THE INVENTION

CATV systems continue to be plagued with service quality problems resulting from loose connections. For the most part, these connectors are loose because they were not installed to the proper torque, which can occur for a number of reasons from laziness, a lacking of training, and improper use of/inadequate tools. An improperly installed connector will result in poor signals, because there are gaps between the devices, resulting in a leak of radio frequency ("RF") signal.

As an example, a cable port is used to transfer an RF signal to a coaxial cable that transmits the signal to video equipment, such as a television. The coaxial cable has, attached to its terminal end, a female cable connector, which is used to house the cable and assist its connection to a cable port. The connector contains a nut that engages the cable port and advances the connector with a coaxial cable to the port. In this instance, the cable connector nut is used to hold two mating surfaces, the cable port and the cable connector housing the coaxial cable. If these two surfaces are not tightly connected, a gap will exist creating a loss in RF signal, resulting in lower quality cable signal.

Improvements on coaxial cable connectors have been proposed to deal with such a problem. An example of such an improvement on a connector is described in U.S. Pat. No. 6,716,062 (Palinkas, et al.), the disclosure of which is herein incorporated by reference. In this patent, a spring element is incorporated to a traditional coaxial cable connector, under a nut element and beneath the flange portion of a post member. The spring biases the connector face towards a port after the nut is rotated around the connector a certain number of times. While this device is effective, it requires time and cost in the manufacturing process of the connector.

Therefore, it is desired in the art to have a flexible device that can be used with existing connectors to prevent RF signal leakage.

Furthermore, it is desired in the art to have a connector capable of making a tight mechanical and electrical connection.

SUMMARY OF THE INVENTION

The present invention incorporates a flexible RF seal into the ground face of a typical connector. A flange end of the seal makes a compliant contract between the port and connector faces, as in the above example, when the nut is partially tightened, and becomes sandwiched firmly between the ground surfaces when the nut is properly tightened. This allows the connector to make a uniform RF seal on a port even with a range of tightening torques.

The present invention incorporates a flexible RF seal which can be fitted into a coaxial cable connector, which decreases the amount of RF leakage produced by that coaxial connector when in place. The flexible RF seal is a simple device made of a conductive and resilient material having three regions: a flexible brim, a transition band for maintaining the flex of the resilient brim, and a tubular insert. Further, there is defined within the seal an insert chamber. In its first embodiment, the flexible brim is angled outward away from the insert chamber. In the second embodiment, the flexible brim is angled inward towards the insert chamber.

Moreover, the invention relates to a coaxial cable connector for mounting on a RF port comprising: a post member having a flange end and a stem having a substantially cylindrical bore therethrough; a nut having at one end inner threading and at the other end a flange to engage the flange end of the post; a body member; a compression ring; and flexible means for providing a uniform electrical connection between the post and the RF port.

The invention, also, relates to a method for making a connector for mounting on the terminal end of a coaxial cable. The method of making a connector for mounting on a RF port comprising: providing a post having a flange end and a stem having a substantially cylindrical bore therethrough; a nut having at one end inner threading and at the other end a flange; a body member; a compression ring, and a flexible RF seal having a flexible brim, a transition band, and a tubular insert; attaching the post to the flanged end of the nut to engage the flange end of the post; attaching the body member to the stem of the post; attaching the compression ring to the body member; and attaching the flexible RF seal to the post.

Furthermore, the invention relates to a method for making a uniform RF seal between a RF port and a coaxial cable comprising: providing a connector comprising a nut, a post, body member, a compression ring; a flexible RF seal comprising a flexible brim, a transition band, and a tubular insert; a coaxial cable; and a RF port; attaching the flexible RF seal to the connector; attaching the connector to a terminal end of a coaxial cable; and connecting the coaxial cable with the connector and flexible RF seal to a RF port.

An advantage of the present invention is that the flexible RF seal provides a tight connection between a cable port and the connector face, when there is a gap between the faces due to improper installation. Thus, the RF seal can provide at the least a contact between the port and the connector to prevent RF signal leakage, and if properly installed firmly compressed between the port and the connector.

A further advantage of the present invention is that the invention provides an easy to install, highly reliable solution to providing an electronic connection that provides an effective RF seal. The device thereby saves time and cost in the manufacturing process. Alternatively, connectors that may already be in use can be retrofitted with the device for providing a uniform RF seal.

DESCRIPTION OF THE DRAWINGS

Corresponding reference characters indicate corresponding parts throughout the several views. The examples set out herein illustrate two embodiments of the invention but should not be construed as limiting the scope of the invention in any manner.

DESCRIPTION OF THE PREFERRED EMBODIMENT(S)

Figure 1B:
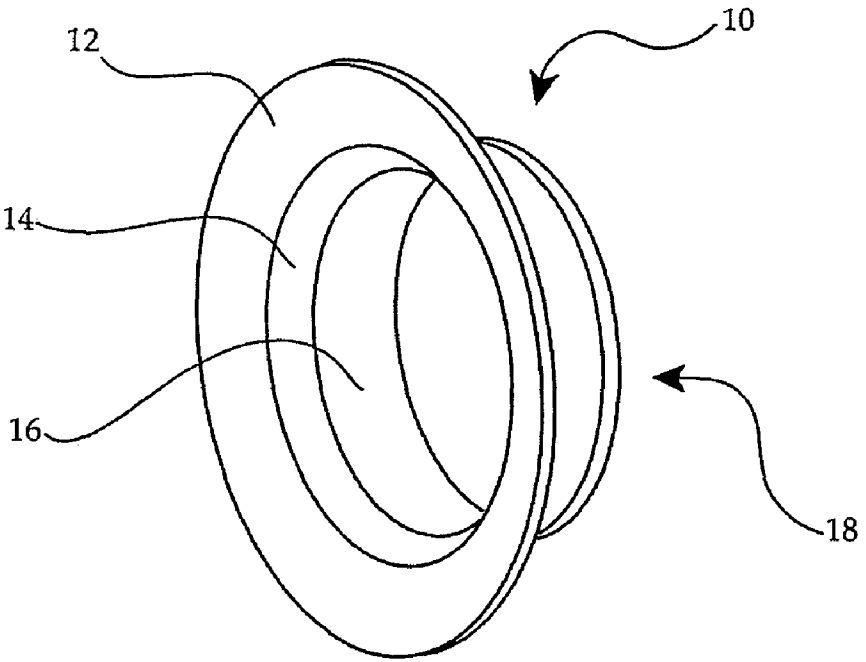
FIG. 1B is an isometric view of the first embodiment of the flexible RF seal of the present invention.
Figure 1A:
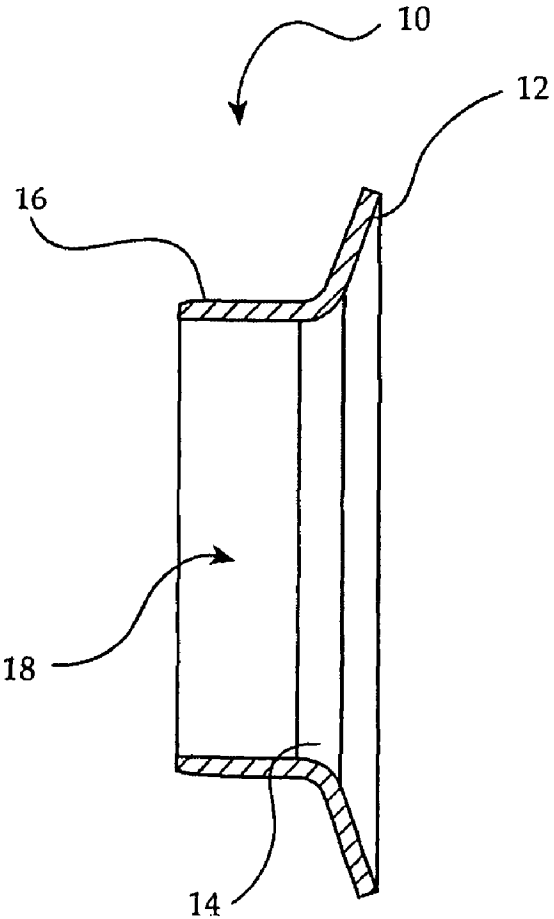
FIG. 1A is a cross-sectional view of the first embodiment of the. flexible RF seal of the present invention.

Referring to FIGS. 1A and 1B, the present invention is a sealing element for coaxial cable connector. More specifically, the sealing element is designed to ensure a solid mechanical and electrical connection between a coaxial cable, connector and part, and thereby termed a flexible radio frequency ("RF") seal 10. There are three regions that define the flexible RF seal 10. First, there is a flexible or resilient brim 12 that is flexible for ensuring a tight connection between a connector and a cable port (not shown) to which it is coupled. Second, there is a transitional band 14, and the band 14 transitions to a tubular insert portion 16. The flexible RF seal 10 also has an insert chamber 18 defined within the seal 10.

The flexible brim 12 is a flange end that, when inserted into a coaxial cable connector, in its first embodiment, sits above a post member, as will be shown and described in greater detail below. The flexible brim 12, in this position, can be pressed against a coaxial port causing the flexible brim 12 to be compressed and bent so that it creates a tight connection between the connector and port. In the first embodiment of the flexible RF seal 10, the flexible brim 12, because of the inner geometries of the coaxial cable connector, is angled, so that it can sit within the connector and seal the connector face to the cable port. Preferably, the flexible brim 12 is seventy-degrees (70°) from the horizontal. The flexible brim 12 is shaped such that the flexible brim 12 is angled away from an insert chamber 18.

The next region of the flexible RF seal 10 is the transitional band 14. Due to the shape of cable connectors in general and the positioning of the flexible RF seal within the connector, there is a band 14 that transitions the flexible brim 12 to the tubular insert portion 16. As shown in FIGS. 1A and 1B, the transition band 14 is a flat, inclined portion on the inside of the seal 10. The transition band 14 assists in the flexibility of the seal 10, in that as a transition portion it allows the flexible brim 12 to further bend or create a greater angle of distance once the flexible brim 12 is engaged by a coaxial port on one end and further compressed by a post member of a connector on its other end.

Figure 3:
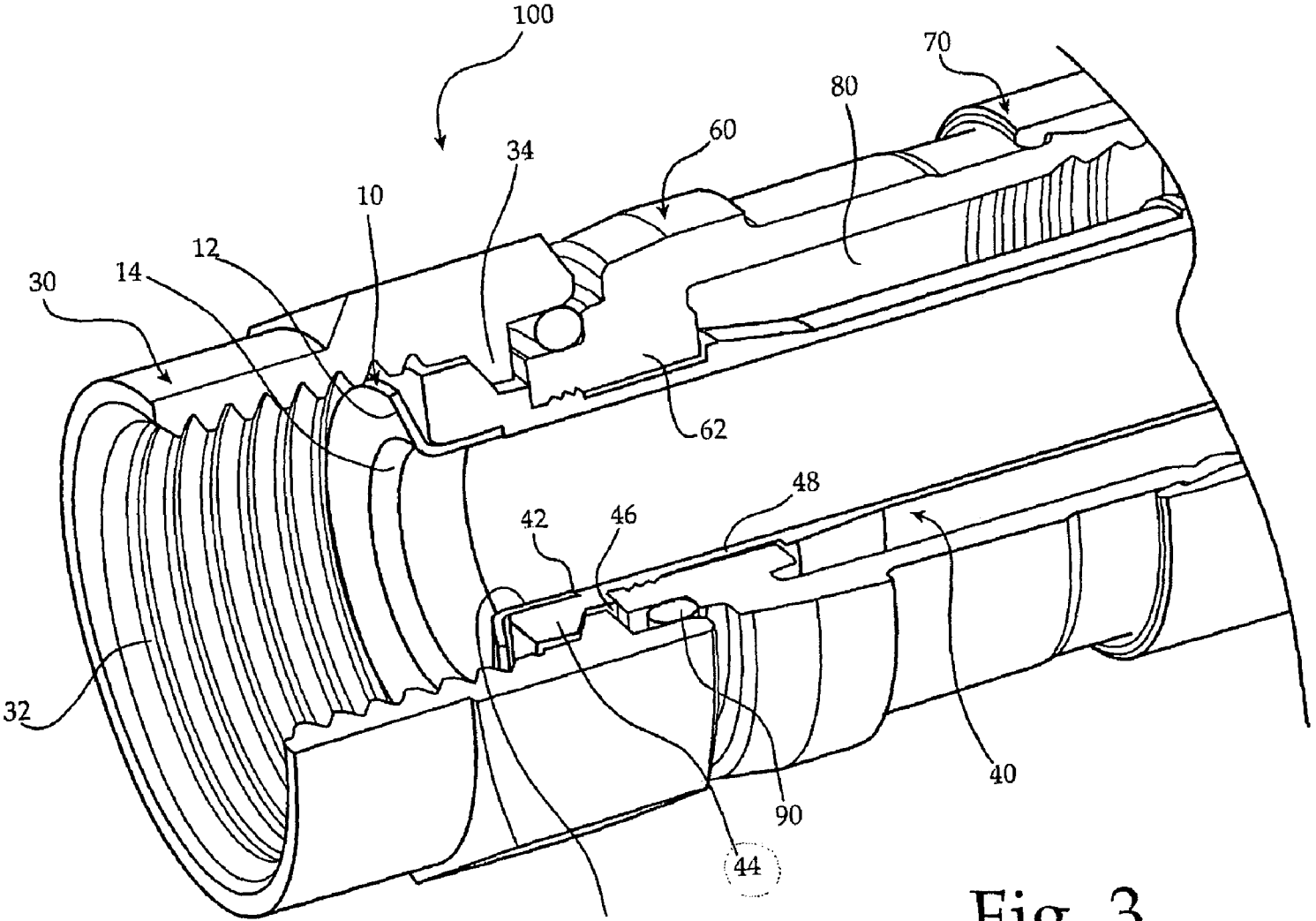
FIG. 3 shows a cross-section of the coaxial cable connector with the first embodiment of the flexible RF seal of the present invention.

The last region of the flexible RF seal is the tubular insert portion 16. The tubular insert portion 16 is below the transition band 14. The tubular insert portion 16 is cylindrical in shape and depending on its embodiment can be used to sit on the inside or outside of a post within a coaxial cable connector. Defined within the tubular insert portion 16 is an insert chamber 18. The tubular insert portion 16, in the first embodiment of the flexible RF seal 10, sits within a post member of a cable connector (as shown in FIG. 3). As a result, the insert chamber 18 assists in housing a coaxial cable on which the cable connector is placed.

Figure 2B:
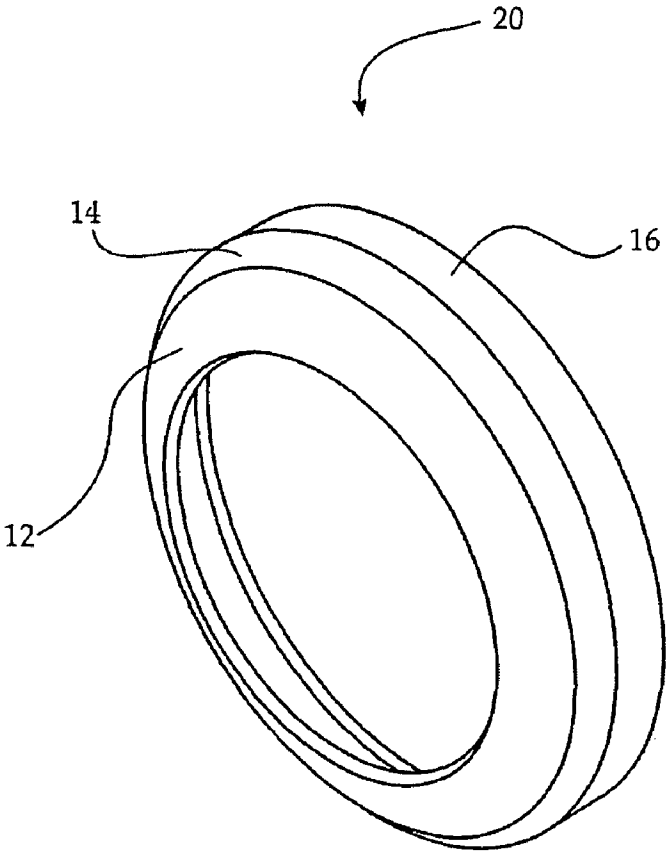
FIG. 2B is an isometric view of the second embodiment of the flexible RF seal of the present invention.
Figure 2A:
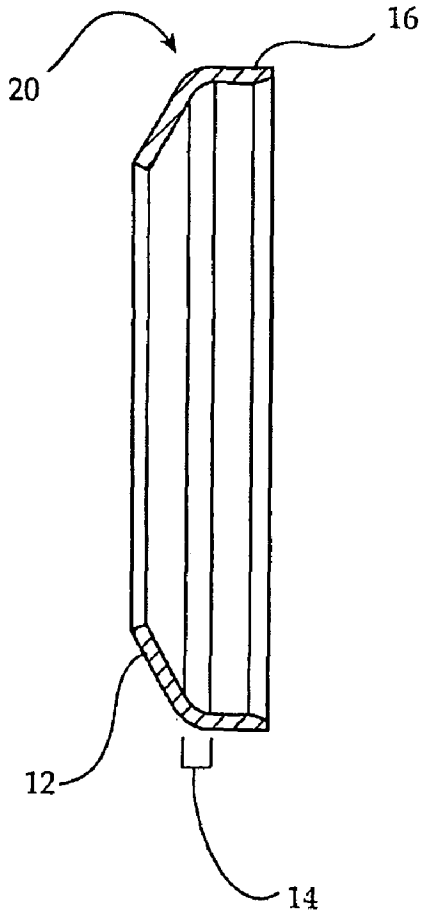
FIG. 2A is a cross-sectional view of the second embodiment of the flexible RF seal of the present invention.

Referring to FIGS. 2A and 2B, there is a second embodiment of the flexible RE seal, denoted by a reference numeral 20. The flexible RF seal 20 has the same three regions as the first embodiment: a flexible brim 12, a transition band 14, and a tubular insert 16. Further, defined within the flexible RF seal 20, as with the first embodiment 10, is an insert chamber 18. The flexible RF seal 20 of this second embodiment has a different shape that the first embodiment 10. The shapes are different because the seal 20 is configured to sit inside a post member. The flexible brim 12 is spaced such that the brim 12 is angled inward towards the insert chamber 18. Moreover, the tubular insert 16 of the flexible RF seal 20 may generally be larger in diameter than the seal 10 because it is configured to sit outside of a post member of the coaxial cable connector.

The flexible RF seal 10, 20 can be made of any suitable material which can assist in providing a tight, solid connection between the surfaces of a coaxial cable connector and a cable port. Suitable materials can include metals such as beryllium copper, spring steel, and phosphor bronze, which are all resilient and allow for flexibility. Further, while the flexible RF seals 10, 20 are shown in with a solid, smooth surface, the seal can have a construction where there are fingered elements, or may further have a wavy construction.

Figure 4:
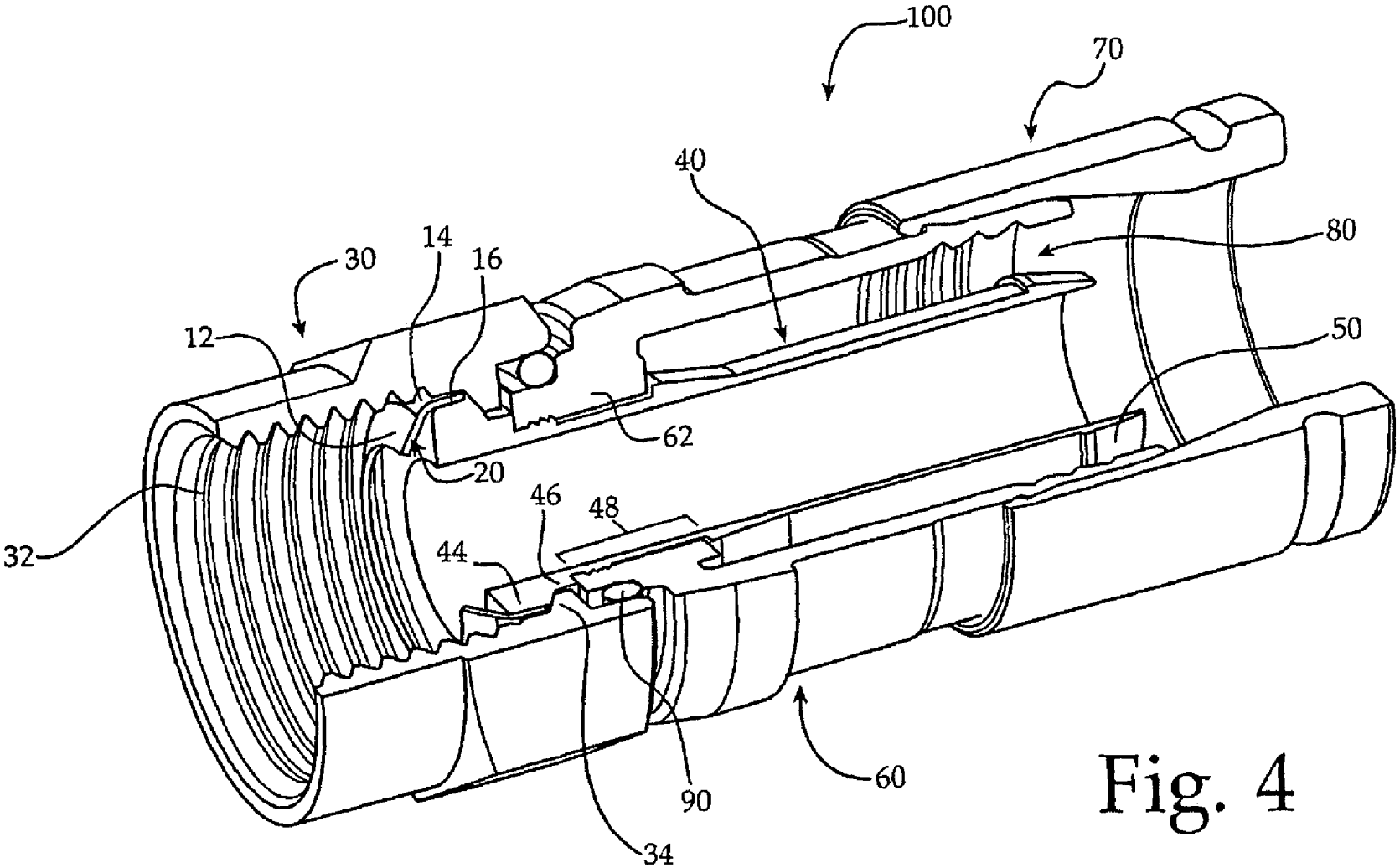
FIG. 4 shows a cross-section of the coaxial cable connector with the second embodiment of the flexible RF seal of the present invention.

In FIGS. 3 and 4, there is shown a conventional coaxial cable connector 100 that is placed on the terminal end of a coaxial cable (not shown). The connector 100 has six elements. First, there is a nut 30 on the terminal end of the connector 100 with a coaxial cable (not shown) to a cable port (not shown). The nut 30 rotates freely around a post 40, so that it can advance the connector 100 and coaxial cable housed within it to a cable port. The nut 30 is interconnected to the post 40 under the flange end 44 of the post 40, whereby there is a nut groove 46 created between the post 40 and a body member 60. Specifically, the nut groove 46 is under the flange end 44 of the post 40 and above body flange end 62. The corresponding nut flange 34 that fits within the nut groove 46 and allows the nut 20 to freely rotate about the connector 100. The post 40 has a cylindrical bore defined through it to house a coaxial cable.

Further, between the nut 30 and the body member 60 is a coupling element 90, such as an O-ring to provide a solid connection between these elements. The body member 60 is also connected to the post 40 through a larger body groove 48, in which the body flange 62 fits. Defined between the body member 60 and the post 40 is a coaxial cable material space 80. A coaxial cable is typically made from several components. Working from the inside to the outside, the inner most part of a cable is a central conductor surrounded by an inner dielectric layer which is covered by a layer of aluminum. Above the aluminum layer is a braided metal layer, and the entire cable is then housed in another dielectric material. There is a lower separator member 50 of post 40 used to separate the coaxial cable between its aluminum layer and braided metallic layer, so that the outer dielectric layer and braided metal layer enter the coaxial cable material space 80, and the aluminum layer, inner dielectric layer, and central conductor layer sit in the cylindrical bore of the post 40. At the very end of the connector 100 is a compression ring 70 which assists in attaching the connector 100 to the terminal end of a coaxial cable.

Referring now to FIG. 3, there is shown a first embodiment of the invention coupled to a conventional coaxial cable connector 100. The post 40 has a lip 42 on which the flexible RF seal 10 sits, The tubular insert 16 sits within the post 40, such that the insert chamber 18 assists in creating a continuous cylindrical bore within which a portion of a coaxial cable (not shown) would be housed. The flexible brim 12 sits above the flange end 44 of the post 40, but is not flush with the flange end 44. The flexible brim 12 is not flush with the flange end 44 so that it can conform to shapes of a cable port (not shown) and the connector 100, and to a greater extent the cable housed within the connector, as sometimes there can be gaps between the cable port and the inner portions of the connector 100 with a cable. As mentioned above, the flexible brim 12 can be, if necessary, pushed backward so that the angle from the horizontal increases from its manufactured positioning. Moreover, the flexible brim 12 can be deformed to ensure a tight connection between the post 40 and the cable port.

Referring to FIG. 4, there is shown a second embodiment of the seal 20. The seal 20 sits on the outside of the flange end 44 of the post 40. In this position, the seal 20 sits between the nut 30, above the nut flange 34 and the outside of the flange end 44 of the post 40. The flexible brim 12 sits above the flange end 44, but is not flush with the flange end 44 so that it can adapt to the shape of both a cable port (not shown) and the connector 100 with a coaxial cable (not shown) housed within it. In this embodiment, the post 40 does not require a lip 42, as was shown in FIG. 3 with the seal 10. Once the connector 100 engages a cable port and is advanced to have an inner conductor of a cable enter the port, the seal 20 can be deformed to a position necessary to fill gaps or tightly connect the connector 100 to the port.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention.

Therefore, it is intended that the invention not be limited to the particular embodiments disclosed as the best mode contemplated for carrying out this invention, but that the invention will include all embodiments failing within the scope and spirit of the appended claims.

I claim:

1. A coaxial cable connector for mounting on a RF port comprising:

a body member having an internal passageway defined along a longitudinal axis of the body member;

a post member having a flange end and a substantially cylindrical bore therethrough, the post member partially disposed within the internal passageway;

a nut having a first nut end with inner threading and a second nut end with a flange to engage the flange end of the post; and, a flexible RF seal comprising: a tubular insert at one end; a flexible brim at an opposing end; and, a transition band between the tubular insert and the flexible brim, wherein the tubular insert is configured to engage the flange end of the post and the transition band is configured to angle the flexible brim inward toward the longitudinal axis, whereby tightening the connector to the port causes the port to deform the flexible brim against the flange end of the post.

2. The connector of claim 1 further comprising:

a compression ring attached to an end of the body member.

3. The method of making a connector for mounting on a RF port comprising:

providing a body member having an internal passageway defined along a longitudinal axis; a post member partially disposed within the internal passageway, the post member having a flange end and a substantially cylindrical bore therethrough; a nut having a first nut end with inner threading and a second nut end with a flange to engage the flange end of the post; a compression ring configured to engage an end of the body member; and, a flexible RF seal comprising: a tubular insert at one end; a flexible brim at an opposing end; and, a transition band between the tubular insert and the flexible brim, wherein the tubular insert is configured to engage the flange end of the post and the transition band is configured to angle the flexible brim inward toward the longitudinal axis, the method comprising:

engaging the flange end of the nut with the flange end of the post;

attaching the body member to the post;

attaching the compression ring to the body member;

attaching the flexible RF seal to the post;

engaging the tubular insert with the flange end of the post; and, tightening the connector to the port to cause the port to deform the flexible brim against the flange end of the post.

4. The method of claim 3 wherein the flexible RF seal is made from a resilient material.

5. The method of claim 4 wherein the resilient material is a metal composition.

6. A coaxial cable connector for mounting on a RF port comprising:

a body member having a first body member end and a second body member end, the body member having defined therein an internal passageway;

a post member having a flange end and a substantially cylindrical bore therethrough, the post member partially disposed within the internal passageway;

a nut having a first nut end with inner threading and a second nut end with a flange to engage the flange end of the post;

a flexible RF seal comprising: a tubular insert at one end; a flexible brim at an opposing end; and, a transition band between the tubular insert and the flexible brim, wherein the tubular insert is placed within the post.

7. The connector of claim 6 further comprising:

a compression ring attached to an end of the body member.

8. The method of making a connector for mounting on a RF port comprising:

providing a body member having an internal passageway defined along a longitudinal axis; a post member partially disposed within the internal passageway, the post member having a flange end and a substantially cylindrical bore therethrough; a nut having a first nut end with inner threading and a second nut end with a flange to engage the flange end of the post; a compression ring configured to engage an end of the body member; and, a flexible RF seal comprising: a tubular insert at one end; a flexible brim at an opposing end; and, a transition band between the tubular insert and the flexible brim, wherein the tubular insert is placed within the post, the method comprising:

engaging the flange end of the nut with the flange end of the post;

attaching the body member to the post;

attaching the compression ring to the body member;

attaching the flexible RF seal to the post;

placing the tubular insert within the post; and, tightening the connector to the port to cause the port to deform the flexible brim against the flange end of the post.

9. The method of claim 8 wherein the flexible RF seal is made from a resilient material.

10. The method of claim 9 wherein the resilient material is a metal composition.

* * * * *